US008523145B2

(12) United States Patent
Lancione et al.

(10) Patent No.: US 8,523,145 B2
(45) Date of Patent: Sep. 3, 2013

(54) JACK ASSEMBLY WITH INTEGRATED PRESSURE RELIEF ASSEMBLY

(75) Inventors: John Anthony Lancione, Granger, IN (US); Timothy Robert Seksinsky, Charlotte, NC (US)

(73) Assignee: Actuant Corporation, Menomonee Falls, WI (US)

( * ) Notice: Subject to any disclaimer, the term of this patent is extended or adjusted under 35 U.S.C. 154(b) by 543 days.

(21) Appl. No.: 12/752,416

(22) Filed: Apr. 1, 2010

(65) Prior Publication Data

US 2010/0252791 A1 Oct. 7, 2010

Related U.S. Application Data

(60) Provisional application No. 61/166,080, filed on Apr. 2, 2009.

(51) Int. Cl.
*B66F 3/24* (2006.01)
*E21D 15/44* (2006.01)

(52) U.S. Cl.
USPC ..... 254/93 R; 254/2 B; 254/9 B; 254/89 H; 60/277

(58) Field of Classification Search
USPC ..... 254/2 B, 8 B, 8 R, 9 B, 9 R, 89 H, 254/93 R; 60/468, 477
See application file for complete search history.

(56) References Cited

U.S. PATENT DOCUMENTS 1,811,556 A * 6/1931 Nilson ..... 254/2 B
1,829,451 A * 10/1931 McNab ..... 254/93 R
1,878,738 A * 9/1932 Warner et al. ..... 405/290
2,708,882 A * 5/1955 Nilson et al. ..... 417/443
3,433,458 A * 3/1969 Norimasa ..... 254/93 R
3,615,157 A * 10/1971 Trotta ..... 254/93 H
4,144,713 A * 3/1979 Clark et al. ..... 60/477
5,088,691 A * 2/1992 Naber et al. ..... 254/8 R
5,461,965 A * 10/1995 Schwaegerle ..... 91/408
7,040,091 B2 * 5/2006 Fan ..... 60/479
7,069,723 B2 * 7/2006 Yamamoto et al. ..... 60/468
7,677,266 B2 * 3/2010 Patterson ..... 137/458
2008/0054239 A1 * 3/2008 Porel ..... 254/93 R

OTHER PUBLICATIONS

Stabilus, SPR 40-07/92, "Gasfeder-Variante (Hydro-Lift)", Jul. 1992.

* cited by examiner

*Primary Examiner* — Brian Glessner
*Assistant Examiner* — Joseph J Sadlon
(74) *Attorney, Agent, or Firm* — Quarles & Brady

(57) ABSTRACT

A jack assembly comprises a cylinder defining an interior, a piston having a piston head slideably engaged with the interior of the cylinder, an extension chamber defined between the piston head and the interior, and a pressure relief assembly integrated proximate the piston head and defining a relief passageway in selective fluid communication with the extension chamber. When a fluid pressure in the extension chamber exceeds a certain level, the pressure relief assembly allows fluid to flow through the relief passageway. In one form, the pressure relief assembly comprises a valve body, a relief passageway defined within the valve body, a valve seat formed along the relief passageway, a plug configured to selectively engage the valve seat, an adjustment member moveable along the relief passageway, and a biasing member captured between the plug and the adjustment member to urge the plug toward the valve seat.

14 Claims, 11 Drawing Sheets

JACK ASSEMBLY WITH INTEGRATED PRESSURE RELIEF ASSEMBLY

CROSS REFERENCES TO RELATED APPLICATIONS

This application claims priority to U.S. provisional application No. 61/166,080 filed Apr. 2, 2009, which is hereby incorporated by reference as if fully set forth herein.

STATEMENT REGARDING FEDERALLY SPONSORED RESEARCH

Not Applicable.

BACKGROUND OF THE INVENTION

The present invention relates generally to a jack assembly, and more particularly to a jack assembly having an integrated pressure relief assembly.

Various types of jack assemblies are used in a wide array of settings; however, in most circumstances, the jack assemblies are configured to perform a generally similar function of providing an axial force. For example, many automotive-style jack assemblies are arranged between the ground and a vehicle to be lifted. Actuating the jack assembly results in the vehicle being raised relative to the ground, and de-actuating the jack assembly results in the vehicle being lowered.

Mechanical and material limitations of jack assemblies require that each jack assembly has a maximum load rating, that is, a particular jack assembly is designed and configured to repeatedly provide a certain amount of axial force. Exceeding the maximum load rating of a jack assembly may result in damaging the jack assembly (e.g., degrading internal seals, deforming portions of the jack assembly, and the like).

As one example, column-type portable vehicle lifts incorporate a caster jack assembly that urges a caster wheel into engagement with the ground to aid in transporting the lift. However, the maximum load rating of the caster jack assembly is significantly lower than the operating load of the vehicle lift. As a result, if the caster jack assembly is inadvertently left in the extended or engaged position while the vehicle lift is used to support a vehicle, the load transferred to the caster jack assembly may result in damage to the caster jack assembly. Other scenarios commonly arise in which the load placed on the jack assembly exceeds the maximum load rating of the jack assembly, therefore degrading or damaging the components of the jack assembly.

To address this potential issue, some jack assemblies incorporate an external pressure relief valve on a hydraulic cylinder that is used to provide the pressurized fluid to extend the jack assembly. If the pressure in the jack assembly exceeds a certain level, the pressure relief valve allows fluid back into the hydraulic cylinder, thus retracting the jack assembly and minimizing potential damage. However, this external tank-valve arrangement is cumbersome and complex.

In light of at least the above considerations, a need exists for an improved jack assembly having an integrated pressure relief assembly.

SUMMARY OF THE INVENTION

In one aspect, a jack assembly comprises a cylinder defining an interior, a piston having a piston head that is slideably engaged with the interior of the cylinder, an extension chamber defined between the piston head and the interior of the cylinder, and a pressure relief assembly integrated proximate the piston head and defining a relief passageway in selective fluid communication with the extension chamber. When a fluid pressure in the extension chamber exceeds a certain level, the pressure relief assembly allows fluid to flow through the relief passageway.

In another aspect, a jack assembly comprises a cylinder defining an interior, a piston having a piston head that is slideably engaged with the interior of the cylinder, an extension chamber defined between the piston head and the interior of the cylinder, and a pressure relief assembly integrated proximate the piston head and defining a relief passageway in fluid communication with the extension chamber. The pressure relief assembly is moveable between a closed position, at which fluid is inhibited from flowing along the relief passageway, and an opened position, at which fluid is permitted to flow along the relief passageway.

In yet another aspect, a pressure relief assembly comprises a valve body, a relief passageway defined within the valve body, a valve seat formed along the relief passageway, a plug configured to selectively engage the valve seat, an adjustment member moveable along the relief passageway, and a biasing member captured between the plug and the adjustment member to urge the plug toward the valve seat.

In another aspect, a jack assembly comprises a cylinder defining an interior, a piston having a piston head including a seal that is slideably engaged with the interior of the cylinder, an extension chamber defined between the piston head and the interior of the cylinder, a valve body coupled to the piston head, a relief passageway defined within the valve body and having an entry port in fluid communication with the extension chamber and an exit port spaced apart from the entry port beyond the seal, a valve seat formed along the relief passageway, a plug configured to selectively engage the valve seat, an adjustment member moveable along the relief passageway, and a biasing member captured between the plug and the adjustment member to urge the plug toward the valve seat. When a fluid pressure in the extension chamber exceeds a certain level, the plug disengages the valve seat such that fluid may flow from the extension chamber, in the entry port, along the relief passageway, and out the exit port.

These and still other aspects of the invention will be apparent from the description that follows. In the detailed description, preferred example embodiments of the invention will be described with reference to the accompanying drawings. These embodiments do not represent the full scope of the invention; rather, the invention may be employed in other embodiments. Reference should therefore be made to the claims for interpreting the breadth of the invention.

DETAILED DESCRIPTION OF THE PREFERRED EXAMPLE EMBODIMENT

An example embodiment of the invention will be described in relation to a caster jack assembly of a column-type vehicle lift. However, the present invention is equally applicable to other types and styles of jack assemblies such as lifts, actuators, struts, shocks, dampers, and the like. In addition, while the example embodiment incorporates hydraulic fluid, any other type of fluid may be used depending upon the ultimate application requirements. Furthermore, given the benefit of this disclosure, one skilled in the art will appreciate the various alternative constructions and material compositions that are within the scope of the invention.

Figure 1:
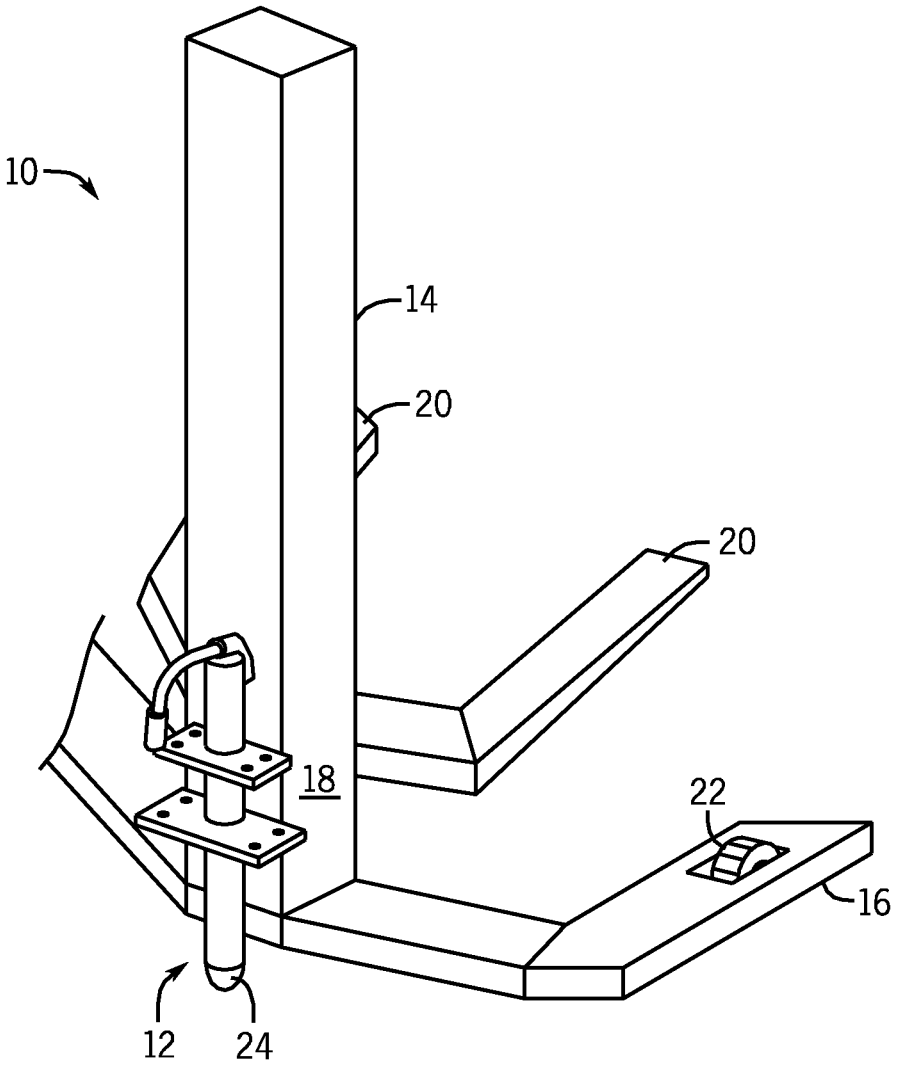
FIG. 1 is a partial isometric view of a column-type portable vehicle lift that incorporates a caster jack assembly in accordance with an aspect of the invention.
Figure 5:
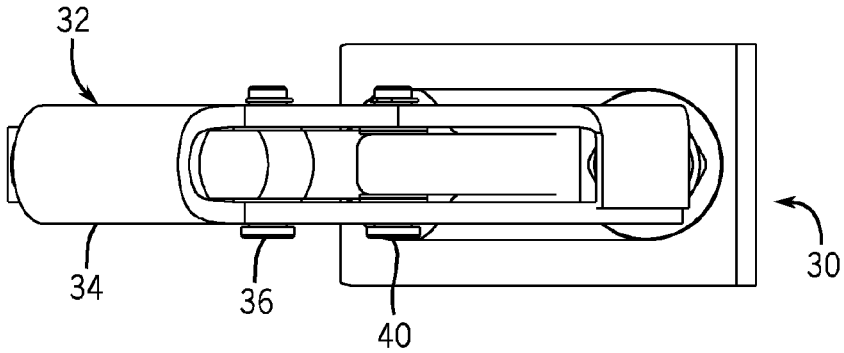
FIG. 5 is a partial side view of the example jack assembly along line 5-5 of FIG. 3.
Figure 2:
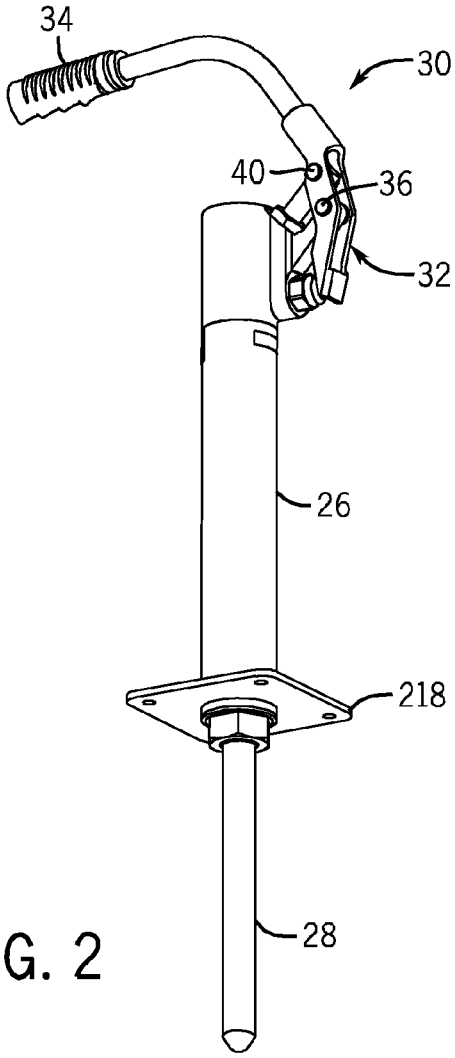
FIG. 2 is an isometric view of an example jack assembly incorporating an aspect of the invention.
Figure 4:
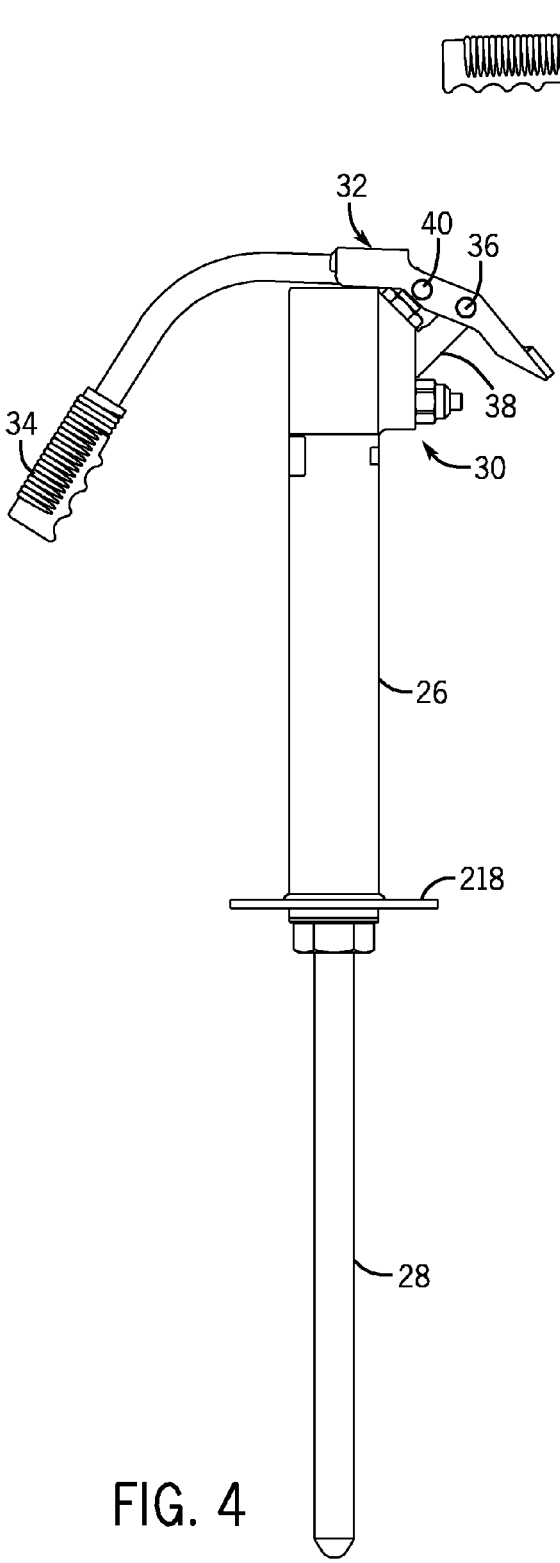
FIG. 4 is a side view of the example jack assembly shown in the extended position.
Figure 3:
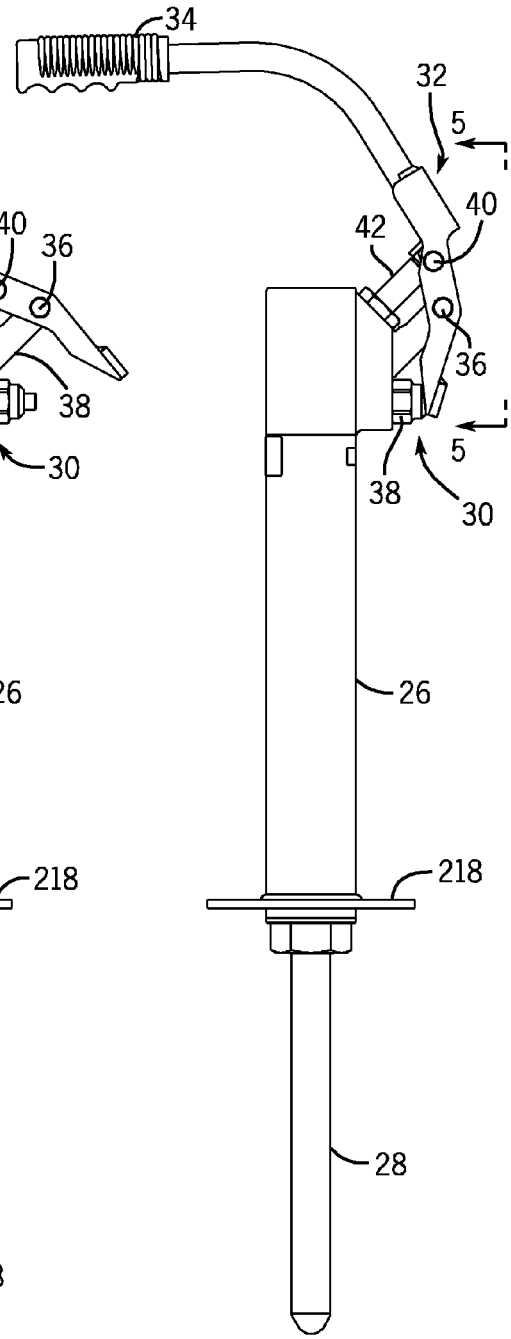
FIG. 3 is a side view of the example jack assembly shown in the retracted position.
Figure 6:
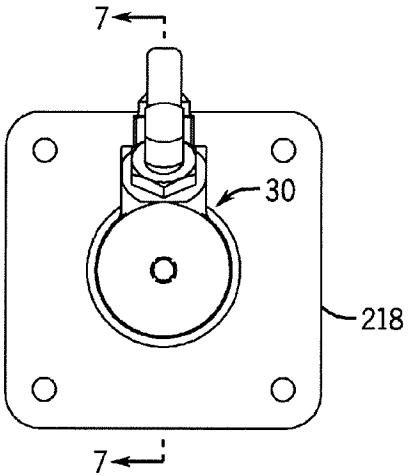
FIG. 6 is a partial top view of the example jack assembly shown with the handle assembly removed.

A simplified example of a column-type portable vehicle lift 10 is shown in FIG. 1 having an example jack assembly 12 incorporating an aspect of the invention. As shown, the vehicle lift 10 includes center support column 14 and a pair of feet 16 extending from the base 18 of the center support column 14. A pair of forks 20 is operatively coupled to the center support column 14 and can be hydraulically actuated to various positions along the center support column 14, thereby selectively raising and lowering a vehicle (not shown) that is carried by the pair of forks 20. Multiple vehicle lifts 10 can be positioned, for example, at the four wheels of a passenger car, to raise and/or lower the entire vehicle. Control of the vehicle lift 10 may be accomplished mechanically, electromechanically, or by any other technique known to those skilled in the art.

As the name implies, the column-type portable vehicle lift 10 is configured to be portable, such as within a vehicle repair shop. To aid the portability of the vehicle lift 10, spring-biased wheels 22 are integrated into the feet 16 and a caster wheel 24 is carried by the jack assembly 12. The jack assembly 12 is configured such that when the jack assembly 12 is extended, the caster wheel 24 is urged into engagement with the ground. The caster wheel 24 is intended to engage the ground when the vehicle lift 10 is not carrying or lifting a vehicle, allowing the vehicle lift 10 to be moved about.

With additional reference to FIGS. 2-5, an embodiment of the jack assembly 12 incorporating an aspect of the invention is shown in greater detail (with the caster wheel 24 and associated components removed). One skilled in the art will appreciate that the jack assembly 12 and components thereof are comprised of application-specific materials. For example, high strength steel may be used for structural components in applications subject to substantial loads (e.g., lifting a vehicle, such as a dump truck). Other components (e.g., seals, handles, springs, etc.) may be comprised of traditional materials (e.g., rubber, plastic, metal, composites, etc.), as will be appreciated by one skilled in the art.

The jack assembly 12 generally includes a cylinder portion 26, a piston portion 28, and an actuator assembly 30. In the example shown, the actuator assembly 30 comprises a manual pump assembly 32; however, as one skilled in the art will appreciate given the benefit of this disclosure, the actuator assembly 30 may be any number of constructions and devices capable of actuating the jack assembly 12. For example, the actuator assembly 30 may comprise a two-way valve in fluid communication with a pressurized fluid supply such that the valve can be manually or automatically operated to extend and/or retract the jack assembly 12 by directing the pressurized fluid accordingly. In the example embodiment, the pressurized fluid comprises hydraulic fluid; however, the pressurized fluid may be water, gas, or any other suitable fluid given the specifics of the particular application.

Figure 7:
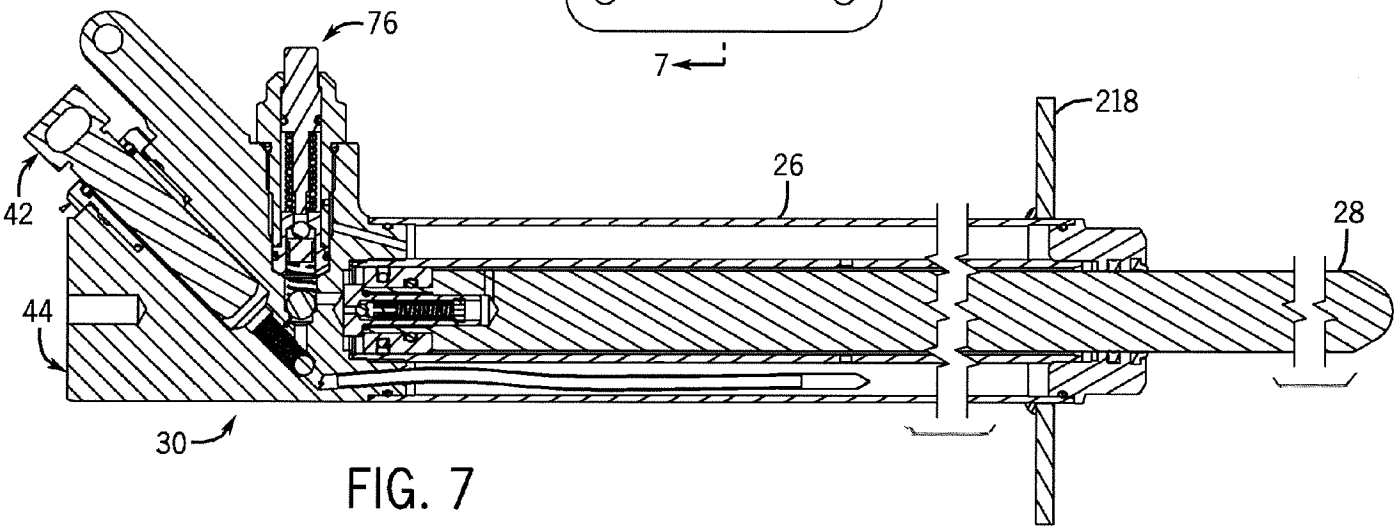
FIG. 7 is a partial cross-section view along line 7-7 of FIG. 6 showing the example jack assembly in the retracted position.

Returning to the example embodiment, the manual pump assembly 32 can be operated to either cause the jack assembly 12 to extend or to allow the jack assembly 12 to retract under load. Specifically, urging the handle 34 from the generally raised position shown in FIG. 3 to the lowered position shown in FIG. 4 extends the piston portion 28. Conversely, urging and maintaining the handle 34 into the extreme position shown in FIG. 3 allows the piston portion 28 to retract in response to an axial, compressive force on the jack assembly 12. The handle 34 pivots about a pivot pin 36 that rotatably captures the handle 34 to a mounting arm 38 that extends outwardly from the cylinder portion 26. A pump pin 40 extends through the handle 34 and a slotted hole 41 (best shown in FIGS. 7 and 8) of a plunger 42 to operationally couple the handle 34 to the plunger 42, such that movement of the handle 34 about the pivot pin 36 results in generally axial movement of the plunger 42.

Turning to FIGS. 6-9, a cross-section of a portion of the jack assembly 12 illustrates the internal operation of the example jack assembly 12. The cylinder portion 26 includes a pump body 44 that defines a pump chamber 46. The pump chamber 46 includes a pump valve seat 48 against which a pump valve ball 50 is biased by a pump spring 52 in a lower portion 54 of the pump chamber 46. An intermediate portion 56 of the pump chamber 46 is sized to slideably engage the plunger 42 during operation of the manual pump assembly 32. An upper portion 58 of the pump chamber 46 defines a seat 60 into which a plunger collar 62 is secured. The plunger collar 62 captures a lower o-ring 64 proximate the intermediate portion 56 of the pump chamber 46. In the example embodiment, the plunger collar 62 is threadably engaged with the upper portion 58 of the pump chamber 46, thereby aiding assembly, disassembly, and repair. An annular groove 66 is formed in an inner wall 68 of a stepped head portion 70 of the plunger collar 62. An upper o-ring 72 is seated in the annular groove 66 and engages the shaft 74 of the plunger 42 during operation of the manual pump assembly 32.

A release valve assembly 76 is operationally coupled to the pump body 44. Specifically, the pump body 44 defines a release chamber 78 that includes an extend valve seat 80 against which an extend valve ball 82 is biased by an extend spring 84 in an inner portion 86 of the release chamber 78. A second end 88 of the extend spring 84 captures a ball guide 90 that rides along an interior passageway 92 of an insert 94. The insert 94 is secured in an intermediate portion 96 of the release chamber 78 proximate the inner portion 86. An o-ring 98 is seated in an external annular groove 100 formed in the insert 94. A release ball 102 is biased against a release valve seat 104 formed at one end 105 of the interior passageway 92 of the insert 94. Specifically, the release ball 102 is urged toward the release valve seat 104 by the ball guide 90 that is in turn urged by the extend spring 84.

A release plunger 106 is slideably captured by a release plunger collar 108 to the pump body 44 such that the release plunger 106 is moveable generally axially within the intermediate portion 96 of the release chamber 78. In the example embodiment, the release plunger collar 108 is threadably engaged with the release chamber 78. An o-ring 110 is captured by a head portion 112 of the release plunger collar 108 proximate an exterior end 114 of the release chamber 78. A sleeve portion 116 of the release plunger collar 108 extends into the release chamber 78 and engages an end face 118 of the insert 94 thereby capturing the insert 94 within the release chamber 78.

The release plunger 106 includes an actuation end 120 extending through an opening 122 in the release plunger collar 108 that is selectively engaged by a portion of the handle 34 during operation to allow the jack assembly 12 to retract. A tip 124 is formed on the opposite end 126 and is configured to selectively extend through an opening 128 formed through the insert 94 where it extends into the interior passageway 92 to selectively unseat the release ball 102 from the release valve seat 104. The release plunger 106 is biased away from the release ball 102 by a spring 130 seated between an end face 132 of the insert 94 and an end face 134 of the release plunger 106. Specifically, the spring 130 surrounds an inner portion 136 of the release plunger 106.

The cylinder portion 26 also includes a cylinder 138 coupled (e.g., threadably fastened) to the pump body 44 at a first end 140. The cylinder 138 defines an interior 142 within which the piston portion 28 slideably engages. The piston portion 28 includes a piston 144 defining an exterior surface 146. The example piston 144 includes a head end 148 to which is coupled a piston head 150 and a support end 152 to which is coupled, for example, the caster wheel 24.

The piston head 150 is sized to slideably fit within the cylinder 138 and includes an annular recess 154 formed in the annular surface 156. An o-ring 158 is seated in the annular recess 154 and a glide ring 160 is seated within the annular recess 154 radially outward from the o-ring 158 such that the glide ring 160 engages and seals against the interior 142 of the cylinder 138.

The piston head 150 of the example embodiment is captured to the head end 148 by a pressure relief assembly 162. More specifically, a threaded valve body 164 engages mating threads 166 formed in a post 168 proximate the head end 148. As one skilled in the art will appreciate, the piston head 150 may alternatively be formed integral with the balance of the piston 144, be welded to the balance of the piston 144, and the like. To seal between the piston head 150 and the post 168, an exterior surface 170 of the post 168 engages an o-ring 172 seated in an annular groove 174 formed along an inner surface 176 of the piston head 150.

The piston 144 extends through an opening 178 formed through an end cap 180 that is secured (e.g., threadably engaged) to a second end 182 of the cylinder 138. In the example embodiment, the end cap 180 includes internal threads 184 that engage external threads 186 formed proximate the second end 182 of the cylinder 138. The exterior surface 146 of the piston 144 engages a quad ring 188 seated in an interior annular groove 190 formed in the end cap 180 and a wiper member 192 seated in another interior annular groove 194 formed in the end cap 180. A reservoir jacket 196 encases the cylinder 138 and is captured between an end face 198 of the pump body 44 and an annular flange 200 formed on the end cap 180. Specifically, the reservoir jacket 196 fits over a protrusion 202 extending from the pump body 44 and seals against an o-ring 204 seated in an annular groove 206 formed in an exterior surface 208 of the protrusion 202. Additionally, the end cap 180 includes a collar 210 over which the reservoir jacket 196 extends and seals against another o-ring 212 seated in an annular groove 214 formed in an exterior surface 216 of the collar 210. In the example embodiment, a mounting flange 218 is coupled (e.g., welded) to the reservoir jacket 196 to allow the jack assembly 12 to be incorporated into another device. The reservoir jacket 196 also defines a reservoir 220 between the cylinder 138 and an interior wall 222 of the reservoir jacket 196. The reservoir 220 is capable of containing the fluid (e.g., hydraulic fluid) used to operate the jack assembly 12.

Figure 9:
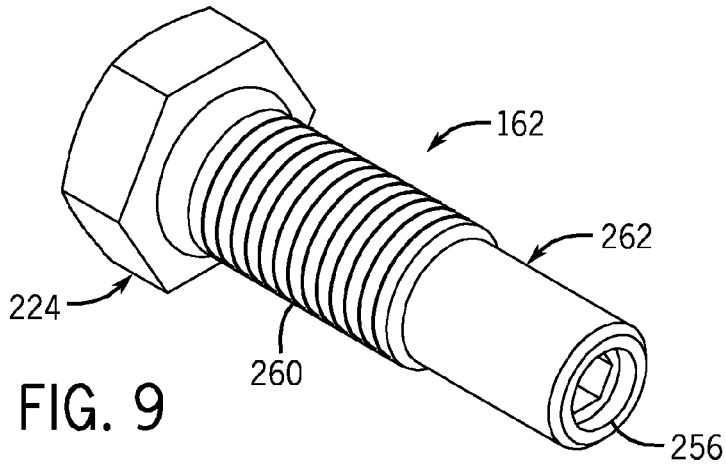
FIG. 9 is an isometric view of an example pressure relief assembly incorporating an aspect of the invention.
Figure 10:
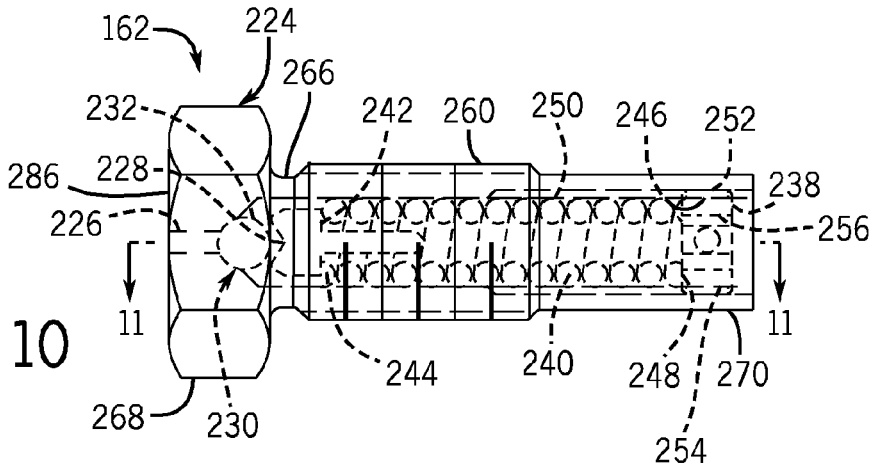
FIG. 10 is a side view of the example pressure relief assembly.
Figure 11:
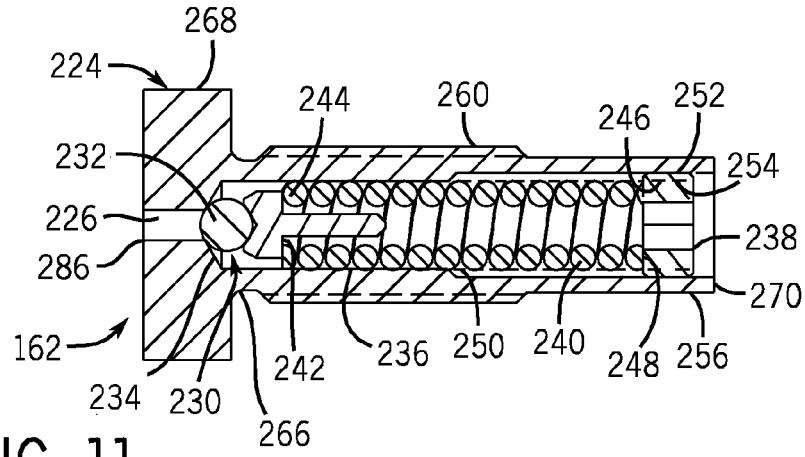
FIG. 11 is a section view along line 12-12 of FIG. 11 showing the example pressure relief assembly in the closed position.

With specific reference to FIGS. 9-11, an example one-way valve assembly in the form of a pressure relief assembly 162 is described below in greater detail. However, given the benefit of this disclosure, one skilled in the art will appreciate that any type of one-way valve assembly may be coupled and integrated into the piston head 150.

The example pressure relief assembly 162 includes a valve body 224 and a relief passageway 226 defined within the valve body 224. A valve seat 228 is formed along the relief passageway 226 and selectively engages a plug 230, shown in the example embodiment as a ball 232 seated in a cradle 234 of an alignment pin 236. The cradle 234 of the alignment pin 236 selectively engages the ball 232 to align the ball 232 with the valve seat 228 when in the closed position shown in FIGS. 10-12. An adjustment member 238 is moveable along the relief passageway 226 and, in the example embodiment, captures a biasing member 240 (e.g., a spring) between the plug 230 and the adjustment member 238. Specifically, an axial face 242 of the alignment pin 236 is configured to engage a first end 244 of the biasing member 240 and an axial face 246 of the adjustment member 238 is configured to engage a second end 248 of the biasing member 240. As a result, the biasing member 240 urges the plug 230 toward the valve seat 228.

Internal threads 250 formed along at least a portion of the relief passageway 226 are configured to engage mating external threads 252 defined by an exterior surface 254 of the adjustment member 238. As a result, the adjustment member 238 is moveable along a longitudinal axis of the valve body 224. In the example embodiment, the adjustment member 238 defines a hexagonal opening 256 into which a mating tool (e.g., a hex key) may be inserted to adjust the position of the adjustment member 238 and ultimately alter the biasing force provided by the biasing member 240 urging the plug 230 toward the valve seat 228.

Returning briefly to FIG. 8, the pressure relief assembly 162 of the example embodiment is shown threadably engaged with a threaded opening 258 formed in the piston head 150 along a longitudinal axis of the piston portion 28. Specifically, the valve body 224 includes engagement threads 260 formed in an external surface 262. An o-ring 264 is seated in an annular groove 266 formed proximate the interface between a head portion 268 and a shaft portion 270 of the valve body 224. In the example embodiment, the valve body 224 is generally in the form of a bolt that has been modified to define the relief passageway 226, valve seat 228, and internal threads 250. One skilled in the art, given the benefit of this disclosure, will appreciate that the valve body 224 may be integral with the piston head 150 or formed of multiple components.

In the example embodiment, the relief passageway 226 is formed generally along a longitudinal axis of the valve body 224 from an entry port 286, through the adjustment member 238, and to an exit port 288. However, the relief passageway 226 need not extend the entire length of the valve body 224 nor through the adjustment member 238. For example, the relief passageway 226 may extend at least partially radially along the valve body 224 such that the exit port 288 is formed along the valve body 224. In addition, the relief passageway 226 may be offset radially from the longitudinal axis of the valve body 224, may be skewed relative to the longitudinal axis of the valve body 224, may include multiple entry ports 286, and may include multiple exit ports 288. The size and contour of the relief passageway 226 need not be generally uniform as illustrated in FIG. 11 and may comprise a variety of contours to further influence the flow of fluid along the relief passageway 226.

Figure 8:
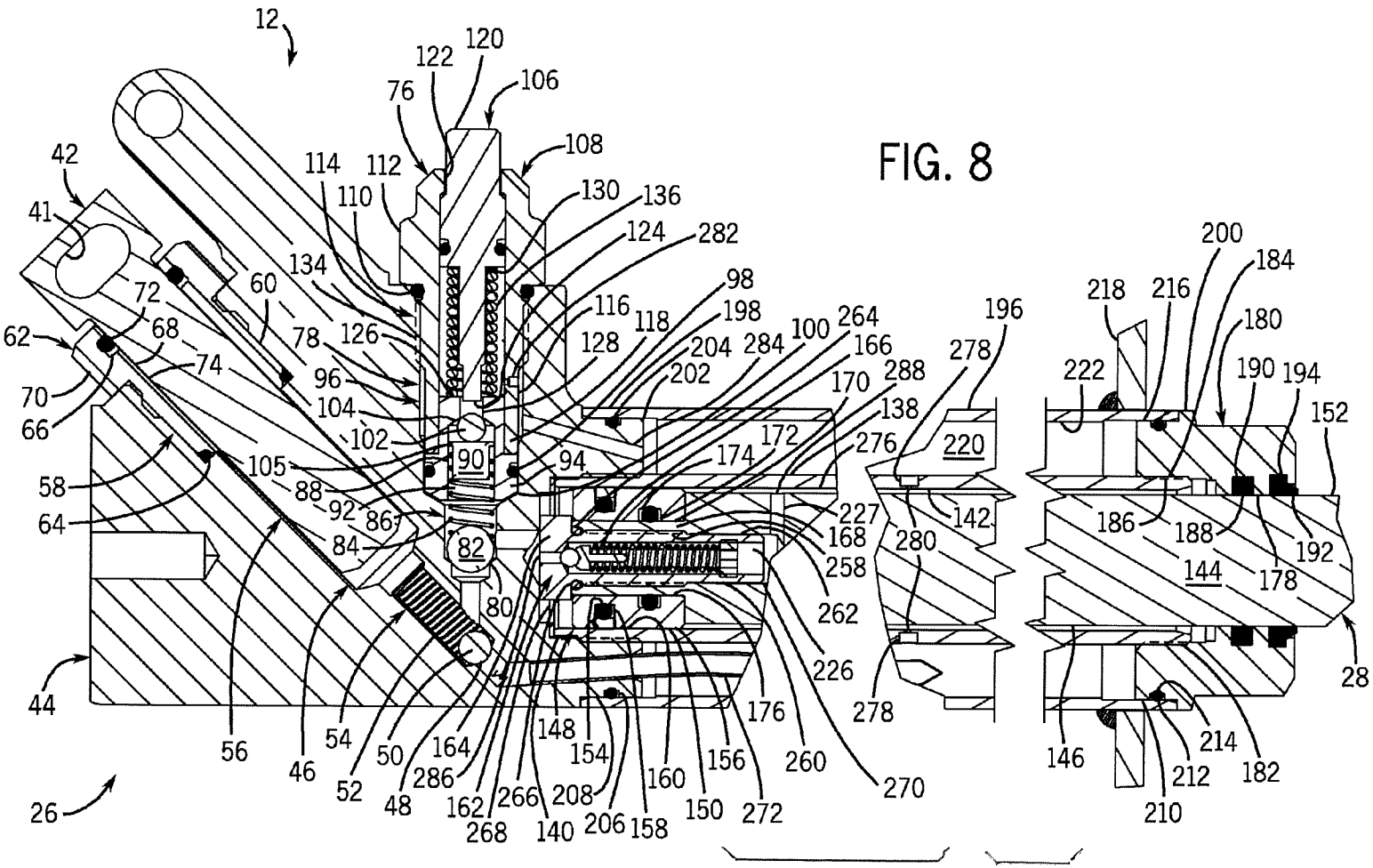
FIG. 8 is a partial cross-section view along line 7-7 of FIG. 6.
Figure 12:
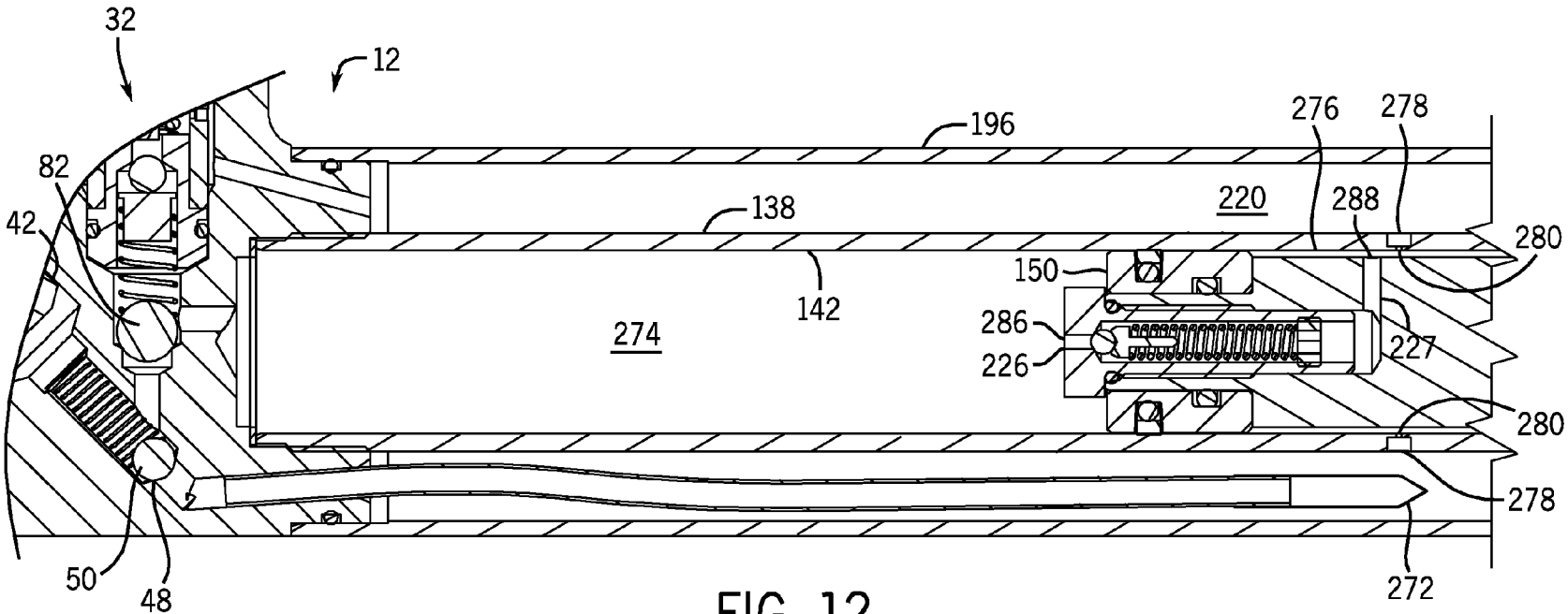
FIG. 12 is a partial cross-section view similar to FIG. 8 showing the example jack assembly in the extended position and the example pressure relief assembly in the closed position.
Figure 13:
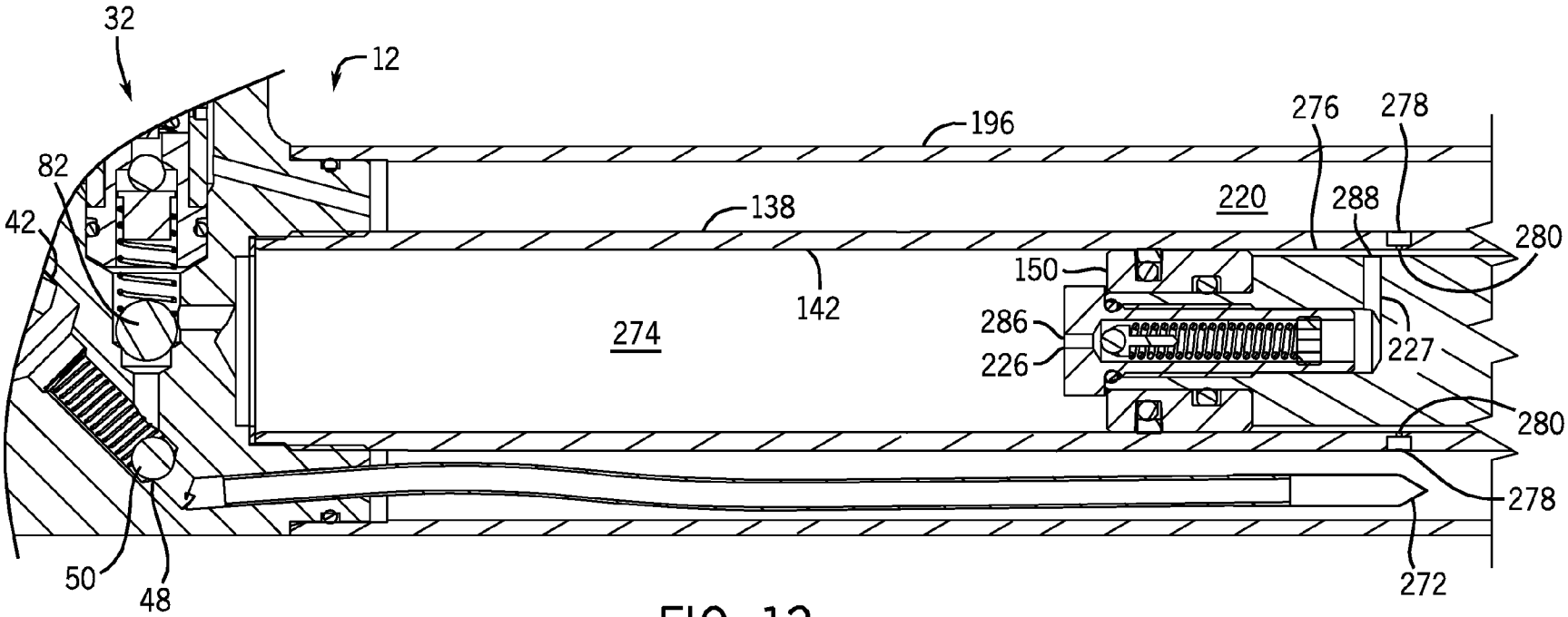
FIG. 13 is a section view similar to FIG. 12 showing the example pressure relief assembly in the opened position.

Turning to FIGS. 8, 12, and 13, the operation of the example jack assembly 12 and the example pressure relief assembly 162 are illustrated and described. In operation, the jack assembly 12 is urged toward the extended position by pumping the manual pump assembly 32. Specifically, as one skilled in the art will appreciate, axial movement of the plunger 42 draws fluid (e.g., hydraulic fluid) through a pickup tube 272 located in the reservoir 220 and past the pump valve ball 50. Returning the plunger 42 to the position shown in FIG. 8 seats the pump valve ball 50 against the pump valve seat 48 and urges the fluid past the extend valve ball 82 and into an extension chamber 274 defined between the piston head 150 and the interior 142 of the cylinder 138.

Urging the handle 34 into engagement with the release valve assembly 76 allows pressurized fluid to flow from the extension chamber 274. Specifically, axially moving the release plunger 106 results in the tip 124 unseating the release ball 102 from the release valve seat 104 such that fluid flows from the extension chamber 274, through a release port 282 and through a release passageway 284 into the reservoir 220.

One skilled in the art will appreciate the variety of structures and configurations available to extend and retract the jack assembly 12. Therefore, the example jack assembly 12 construction described is not limiting.

In the example embodiment, the pressure relief assembly 162 is substantially integrated proximate the piston head 150 such that the relief passageway 226 provides selective fluid communication between the extension chamber 274 and the reservoir 220 (i.e., a generally lower pressure volume). When a fluid pressure in the extension chamber 274 exceeds a certain level (i.e., any acceptable level for the particular application), the pressure relief assembly 162 allows fluid to flow out of the extension chamber 274 and through the relief passageway 226. Specifically, in the example embodiment, the plug 230 allows the fluid to flow past toward a relief cavity 276 defined between the interior 142 of the cylinder 138 and the piston 144. That is, the relief cavity 276 is in fluid communication with the relief passageway 226.

In the example embodiment, the relief passageway 226 includes the entry port 286 proximate the piston head 150 and the exit port 288 positioned beyond the seal (e.g., the glide ring 160 and the o-ring 158) such that the relief passageway 226 selectively permits fluid to flow from the extension chamber 274 and along the relief passageway 226, thereby reducing excessive pressure within the extension chamber 274. The example relief passageway 226 includes a radial portion 227 formed in the piston 144 and extending toward the relief cavity 276. One skilled in the art will appreciate, given the benefit of this disclosures, that the exit port 288 may include a variety of configurations and orientations.

Two relief ports 278 are formed through the cylinder 138 to allow fluid communication between the relief cavity 276 and the reservoir 220. In the example embodiment, two relief ports 278 are shown and each has a stepped construction with a smaller opening 280 proximate the relief cavity 276. Any number, location, and contour of relief ports 278 may be incorporated depending upon the application requirements.

The pressure required to alter the state of the pressure relief assembly 162 from closed to opened may be adjusted. When the fluid pressure exceeds the certain level, as illustrated in the example embodiment, the ball 232 is unseated from the valve seat 228 and the alignment pin 236 compresses the biasing member 240 against the adjustment member 238. Conversely, when the fluid pressure drops below the certain level, the biasing member urges the plug 230 from the opened to the closed position, thereby allowing fluid pressure to increase within the extension chamber 274. Adjusting the location of the adjustment member 238 allows a spring force of the biasing member to be altered, hence increasing or decreasing the fluid pressure in the extension chamber 274 required to open the pressure relief assembly 162 and permit the flow of fluid along the relief passageway 226.

As one skilled in the art will appreciate, given the benefit of this disclosure, if the example jack assembly 12 is extended when the vehicle lift 10 is attempting to lift and/or carry a vehicle, the pressure relief assembly 162 may be configured such that an excessive pressure within the extension chamber 274 will not occur. As one result, damage to the jack assembly 12 may be substantially prevented.

Another example embodiment of a jack assembly 512 incorporating an aspect of the invention is shown generally in FIGS. 14-17. Again, the jack assembly 512 generally includes a cylinder portion 526, a piston portion 528, and an actuator assembly 530. In a preferred form, an end cap 580 secured to a second end 582 of a cylinder 538 is elongated, as compared to the end cap 180 shown best in FIG. 8, and is generally cylindrical in shape. This end cap 580 provides additional bearing surface for the piston portion 528 as it moves axially, enhancing side-loading (e.g., radial loading) capabilities. A bearing sleeve 600 is also included to aid operation of the piston portion 528. One skilled in the art will appreciate the various application-specific modifications that may be made to provide an end cap 580 suited for a particular application.

Figure 14:
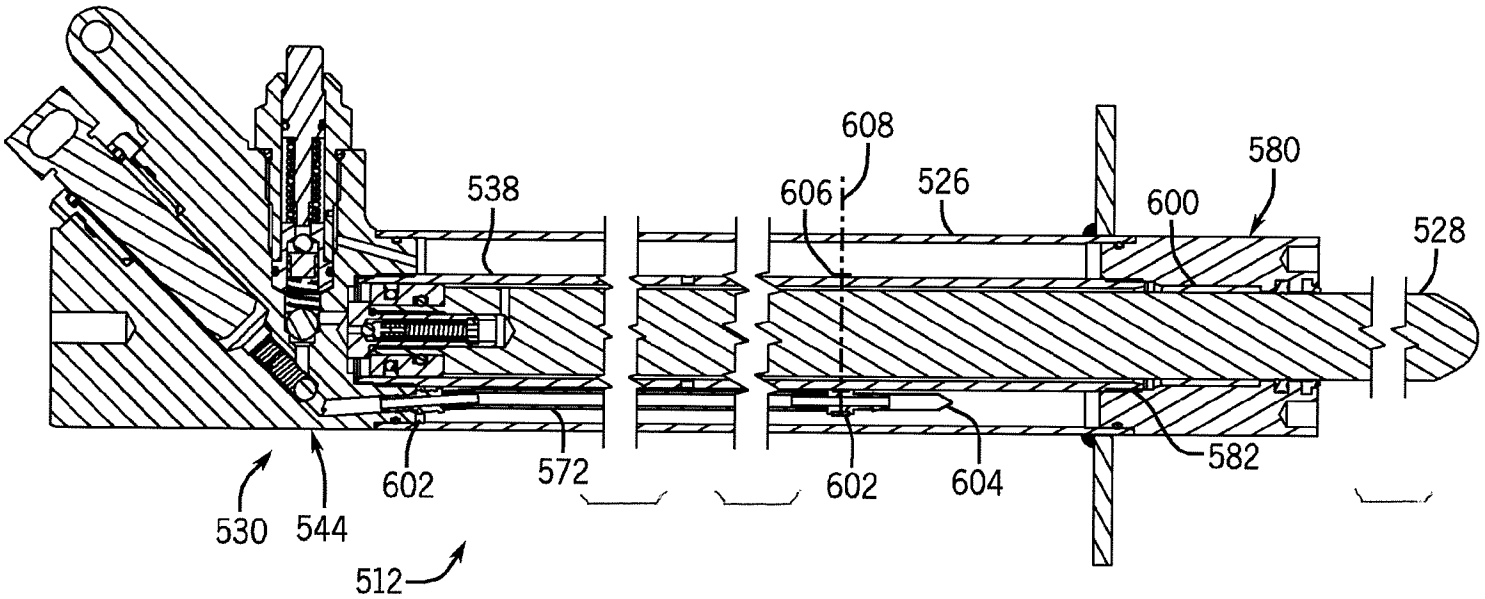
FIG. 14 is a partial cross-section view similar to FIG. 7 showing another example jack assembly in the retracted position.
Figure 16:
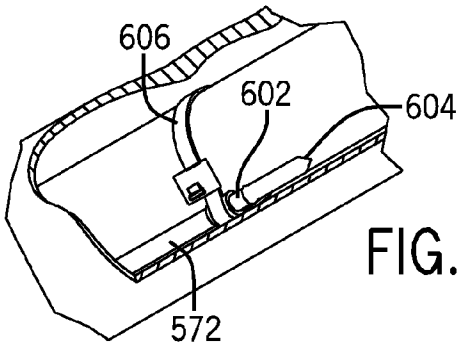
FIG. 16 is a partial cut-out view of a portion of FIG. 14.
Figure 15:
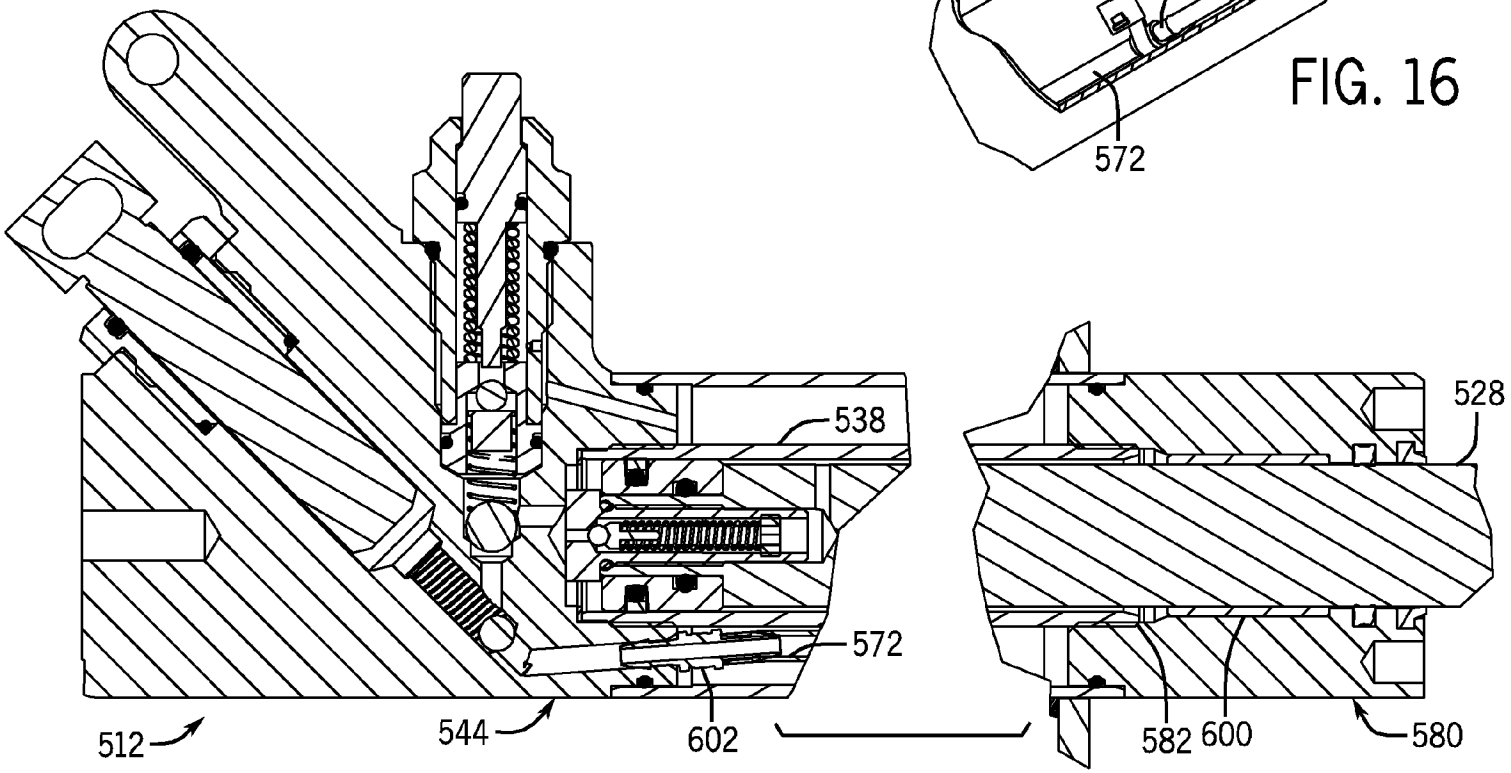
FIG. 15 is a partial cross-section view of FIG. 14.

In another preferred form shown in FIGS. 14-16, a pickup tube 572 is secured at both ends by barbed couplers 602 to a pump body 544 at one end and a screen 604 at the opposite end. The barbed couplers 602 are preferably made of plastic and provide a sufficient seal to enhance proper flow of fluid through the pickup tube 572. As best shown in FIG. 16, the pickup tube 572 is preferably secured relative to the cylinder 538 by a cable tie 606. The cable tie 606 inhibits the pickup tube 572 from "curling" or otherwise being displaced from a location allowing fluid to flow through the pickup tube 572 while in use. For instance, when used in a vertical orientation (such as shown in FIG. 1), the screen 604 of the pickup tube 572 is preferably located sufficiently below a fill line 608 such that the screen 604 will remain within the fluid during normal operation.

Figure 17:
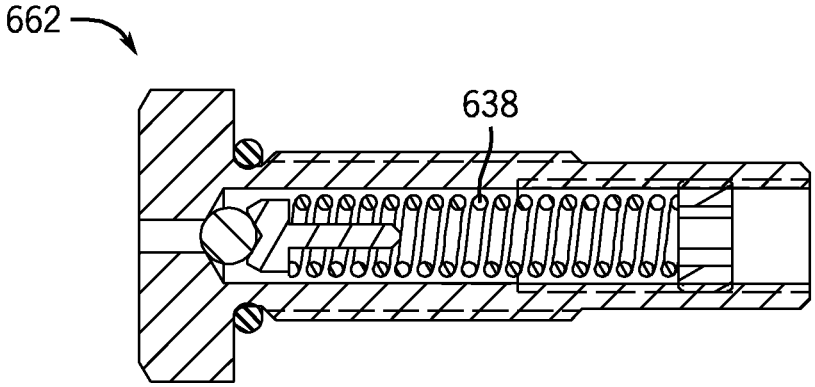
FIG. 17 is a section view showing another example pressure relief assembly in the closed position.

Turning briefly to FIG. 17, an alternative example pressure relief assembly 662 is illustrated. The notable distinction between the example described with reference to FIGS. 9-11 is the alteration of a biasing member 638, that is, the example spring shown in FIG. 17 includes more turns of a higher gauge wire.

Given the benefit of this disclosure, one skilled in the art will appreciate that various one-way valve assemblies may be integrated with the piston to provide an integrated pressure relief assembly, each of which is within the scope of the present invention.

While there has been shown and described what is at present considered the preferred embodiments of the invention, it will be obvious to those skilled in the art that various changes and modifications can be made, given the benefit of this disclosure, without departing from the scope of the invention defined by the following claims.

We claim:

1. A jack assembly, comprising: a cylinder defining an interior; a piston having a piston head that is slideably engaged with the interior of the cylinder; an extension chamber defined between the piston head and the interior of the cylinder; and a pressure relief assembly in the piston head and defining a relief passageway in selective fluid communication with the extension chamber; the pressure relief assembly being responsive to fluid pressure in the extension chamber so that when the fluid pressure in the extension chamber exceeds a certain level the pressure relief assembly causes fluid to flow through the relief passageway, wherein the pressure relief assembly comprises a one-way valve assembly coupled to the piston for selectively permitting the fluid to flow from the extension chamber toward the relief cavity, the one-way valve assembly further comprising a valve body engaged with the piston and defining the relief passageway; a valve seat defined by the valve body; and a plug biased toward the valve seat to inhibit flow of the fluid through the relief passageway.

2. The jack assembly of claim 1, further comprising: a relief cavity defined between the interior of the cylinder and the piston; wherein the relief cavity is in fluid communication with the relief passageway.

3. The jack assembly of claim 2, further comprising: a reservoir jacket adjacent the cylinder defining a reservoir; and at least one relief port formed in the cylinder such that the reservoir is in fluid communication with the relief cavity.

4. The jack assembly of claim 1, wherein the valve body is threadably engaged with the piston.

5. The jack assembly of claim 4, wherein an axis of the valve body is substantially parallel with an axis of the piston.

6. The jack assembly of claim 5, further comprising: threads formed along at least a portion of the relief passageway; an adjustment member threadably engaged with the threads formed along at least a portion of the relief passageway; and a spring captured between the plug and the adjustment member such that the plug is biased toward the valve seat by a spring force that is adjustable by altering a location of the adjustment member within the relief passageway.

7. The jack assembly of claim 6, wherein the plug further comprises: a ball; and an alignment pin defining a cradle that selectively engages the ball to align the ball with the valve seat.

8. The jack assembly of claim 7, wherein the adjustment member includes an opening defining a portion of the relief passageway.

9. The jack assembly of claim 8, wherein the opening is hexagonal.

10. A jack assembly, comprising: a cylinder defining an interior; a piston having a piston head including a seal that is slideably engaged with the interior of the cylinder; an extension chamber defined between the piston head and the interior of the cylinder; a valve body in the piston head; a relief passageway defined within the valve body and having an entry port in fluid communication with the extension chamber and an exit port spaced apart from the entry port beyond the seal; a valve seat formed along the relief passageway; a plug configured to selectively engage the valve seat; an adjustment member moveable along the relief passageway; and a biasing member captured between the plug and the adjustment member to urge the plug toward the valve seat; the pressure relief assembly being responsive to fluid pressure in the extension chamber so that when the fluid pressure in the extension chamber exceeds a certain level the plug disengages the valve seat such that fluid flows from the extension chamber, in the entry port, along the relief passageway, and out the exit port.

11. The jack assembly of claim 10, wherein the valve body is threadably engaged to the piston head.

12. The jack assembly of claim 10, wherein a longitudinal axis of the valve body and a longitudinal axis of the piston head are substantially parallel.

13. The jack assembly of claim 10, wherein the adjustment member includes an opening defining a portion of the relief passageway.

14. The jack assembly of claim 10, wherein the exit port is formed within the piston.

* * * * *